US007591537B2

(12) United States Patent
Tsuchii et al.

(10) Patent No.: US 7,591,537 B2
(45) Date of Patent: Sep. 22, 2009

(54) INK JET RECORDING HEAD

(75) Inventors: Ken Tsuchii, Sagamihara (JP); Mineo Kaneko, Tokyo (JP); Toru Yamane, Yokohama (JP); Masaki Oikawa, Inagi (JP); Keiji Tomizawa, Yokohama (JP); Mitsuhiro Matsumoto, Yokohama (JP); Shuichi Ide, Tokyo (JP); Kansui Takino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 53 days.

(21) Appl. No.: 11/774,104

(22) Filed: Jul. 6, 2007

(65) Prior Publication Data

US 2008/0012898 A1 Jan. 17, 2008

(30) Foreign Application Priority Data

Jul. 11, 2006 (JP) ..... 2006-190281

(51) Int. Cl.
*B41J 2/205* (2006.01)

(52) U.S. Cl. ..... 347/43; 347/40

(58) Field of Classification Search ..... 347/12, 347/15, 40, 41, 43
See application file for complete search history.

(56) References Cited

U.S. PATENT DOCUMENTS

| | | | | |
|---|---|---|---|---|
| 5,956,056 | A | 9/1999 | Kaneko et al. | 347/43 |
| 6,137,510 | A | 10/2000 | Sato et al. | 347/63 |
| 6,186,616 | B1 | 2/2001 | Inoue et al. | 347/45 |
| 6,325,489 | B2 * | 12/2001 | Endo | 347/43 |
| 6,575,560 | B2 | 6/2003 | Kaneko et al. | 347/43 |
| 6,688,728 | B2 | 2/2004 | Watanabe et al. | 347/43 |
| 6,789,877 | B2 * | 9/2004 | Murakami et al. | 347/40 |
| 6,830,317 | B2 | 12/2004 | Tsuchii et al. | 347/56 |
| 6,964,467 | B2 | 11/2005 | Kaneko et al. | 347/40 |
| 6,976,748 | B2 | 12/2005 | Yabe et al. | 347/43 |
| 7,077,500 | B2 | 7/2006 | Yabe | 347/40 |
| 2002/0105557 | A1 * | 8/2002 | Teshigawara et al. | 347/15 |
| 2006/0038850 | A1 | 2/2006 | Teshigawara et al. | 347/43 |
| 2006/0050107 | A1 | 3/2006 | Yamanaka et al. | 347/40 |

(Continued)

FOREIGN PATENT DOCUMENTS

EP 0 931 064 A2 7/1999

(Continued)

*Primary Examiner*—Lamson D Nguyen
(74) *Attorney, Agent, or Firm*—Fitzpatrick, Cella, Harper & Scinto

(57) ABSTRACT

An ink jet head movable in a main scan direction includes first and second groups of ejection outlet arrays disposed on either side of a common liquid chamber and including plural ejection outlet arrays. In the first group, amounts of liquid ejected from outlets of first and second ejection outlet arrays, which are staggered, differ from each other. In the second group, a common ejection amount ejection outlet array ejects the same amount of liquid as that of one of the first and second ejection outlet arrays and a non-common ejection amount ejection outlet array ejects an amount of the liquid that differs from that of the first ejection outlet array group. The ejection outlets of the common and non-common ejection amount ejection outlet arrays are disposed in a staggered arrangement. The ejection outlets of the second ejection outlet array group are disposed with deviation of ½ of an interval at which the ejection outlets of the first ejection outlet array group are arranged. Different sets of the same cyan and magenta colors in the non-common ejection amount ejection outlet arrays are disposed with deviation of ½ of an interval at which the ejection outlets of the non-common ejection amount ejection outlet arrays of other sets are arranged.

10 Claims, 7 Drawing Sheets

U.S. PATENT DOCUMENTS

2006/0050110 A1 3/2006 Osada et al. ..... 347/47

FOREIGN PATENT DOCUMENTS

JP 9-164706 6/1997
JP 2006-168142 6/2006
JP 2006-168143 6/2006
WO WO 87/03363 6/1987

* cited by examiner

INK JET RECORDING HEAD

FIELD OF THE INVENTION AND RELATED ART

The present invention relates to an ink jet recording head for an ink jet printer.

In recent years, the need has been rapidly increasing for printing apparatuses, in particular, ink jet printing apparatuses, which are capable of printing high quality images at a substantially higher speed than a conventional printing apparatuses.

However, a high speed ink jet recording apparatus suffers from the following problem. That is, when a high speed ink jet recording apparatus is in the high speed mode, its recording head is made to jet inks different in color not only while it is moved forward, but also, while it moved backward. Therefore, the order in which the inks different in color are deposited on recording medium while the head is moved forward is different from the order in which the inks different in color are deposited on recording medium while the head is moved backward. This difference is likely to result in the formation of an image which is nonuniform in color. U.S. Pat. No. 6,964,467 discloses a method which reduces this likelihood of the occurrence of this problem. According to this patent, the recording head is provided with two rows of recording nozzles per color, and the two rows of recording nozzles are symmetrically positioned with respect to a preset referential line (which hereafter may be referred to as symmetrical head).

U.S. Pat. No. 7,077,500 discloses another symmetrical head. According to this patent, in order to enable the recording head to print image which are substantially higher in quality, the head (which hereafter may be referred to as symmetrical head of two ink droplet size type) is provided with two rows (two groups) of nozzles, that is, a row (group) of nozzles and a row (group) of nozzles capable of jetting small ink droplets, and the two rows (two groups) of nozzles are symmetrically positioned.

Further, Japanese Laid-open Patent Application H09-164706 discloses an ink jet recording head which is also for forming images which are substantially higher in quality. According to this patent application, as the means for further improve the ink jet recording head in image quality, the head is provided with three rows of nozzles, that is, a row of nozzles which jet large ink droplets, a row of nozzles which jet medium ink droplets, and a row of nozzles which jet small ink droplets.

However, an attempt to simply integrate the above described symmetrical head structure with the head having the large ink droplet jetting nozzle row, medium ink droplet jetting nozzle row, and small ink droplet jetting nozzle row, created the following problem. That is, it made it impossible to increase the ink jet recording head in nozzle density (resolution). More concretely, the resultant ink jet recording head was smaller in the ratio (where hereafter will be referred to as AF) at which a given section of a sheet of paper was covered with dots each time the head passed the section. Therefore, when the number of times the ink jet recording head was moved across a given section of a sheet of paper, to complete the section of image, which corresponded to this section of the sheet of paper, was small, the recording apparatus was likely to form streaky images.

Shown in FIGS. 7A and 7B is an example of the structural integration made to solve the above described problem, between the abovementioned symmetrical ink jet recording head, and the ink jet recording head having the large ink droplet jetting nozzle row, medium ink droplet jetting nozzle row, and small ink droplet jetting nozzle row. FIG. 7A is a schematic plan view of the ink jet recording head structured as described above, as seen from the side having the ink droplet jetting nozzles.

Designated by referential symbols CL1 and CL2 are rows of ink jetting nozzles which are for jetting large droplets of cyan ink, and designated by referential symbols CM1 and CM2 are rows of ink jetting nozzles which are for jetting medium droplets of cyan ink. Designated by referential symbols CS1 and CS2 are rows of ink jetting nozzles which are for jetting small droplets of cyan ink.

Designated by referential symbols ML1 and ML2 are rows of ink jetting nozzles which are for jetting large droplets of magenta ink, and designated by referential symbols MM1 and MM2 are rows of ink jetting nozzles which are for jetting medium droplets of magenta ink. Designated by referential symbols MS1 and MS2 are rows of ink jetting nozzles which are for jetting small droplets of magenta ink.

Designated by referential symbols YL1 and YL2 are rows of ink jetting nozzles which are for jetting large droplets of yellow ink.

Designated by referential symbols C1*a* is a common liquid chamber for supplying CL1 and CM2 with ink, and C1*b* is a common liquid chamber for supplying CS1 with ink. Designated by a referential symbol C2*a* is a common liquid chamber for supplying CL2 and CM2 with ink, and designated by a referential symbol C2*b* is a common liquid chamber for supplying CS2 with ink.

Designated by referential symbols M1*a* is a common liquid chamber for supplying ML1 and MM1 with ink, and M1*b* is a common liquid chamber for supplying MS1 with ink. Designated by a referential symbol M2*a* is a common liquid chamber for supplying ML2 and MM2 with ink. Designated by a referential symbol M2*b* is a common liquid chamber for supplying MS2 with ink.

Designated by a referential symbol Ya is a common liquid chamber for supplying YL1 and YM2 with ink.

The rows of large ink jetting nozzles for jetting large ink droplets are larger in heater size. Therefore, the large ink droplet jetting nozzle row requires a large space, making it impossible to place multiple large ink droplet jetting nozzle rows at a high density on one side of the common liquid chamber. The ink jet recording head shown in FIG. 7A is one of the examples of ink jet recording head which have been realized so far. In this case, the nozzle density of each large ink droplet jetting nozzle row is 600 nozzles per inch, or dpn (which corresponds to "dot per inch, or dpi"), that is, 600 dpn ("dpi") per side of the common liquid chamber.

In terms of the secondary scan direction, the nozzles of small ink droplet jetting nozzle rows CS1, CS2, MS1, and MS2 are offset by half the nozzle pitch of the large ink droplet jetting nozzle row. The employment of this arrangement makes it possible for medium dots and small dots to be printed at a combined resolution of 2,400 dpi, which is twice the resolution at which large dots can be printed by this recording head. Therefore, the AF by medium dots and small dots are greater. Therefore, this recording head is less likely to form streaky images when it is operated in a low resolution mode.

In the case of this arrangement, however, the order in which the medium dots and small dots are arranged in terms of the secondary scan direction becomes "medium dot, medium dot, small dot, small dot, medium dot, medium dot, small dot, small dot, . . . and so on". That is, two raster made up of two medium dots, and 2 raster made up of two small dots, alternate. If an attempt is made to achieve a certain level of tone with use of dither method or error diffusion method and an ink jet recording head whose ink jetting nozzles are arrangement as described above, adjacent medium dots are likely to be formed joined with each other on recording medium, being therefore likely to form one large dot, which in turn is likely to make the resultant image appear grainy, should ink droplets deviate in landing spot. In addition, adjacent small ink droplets are also likely to join as they are formed, as are the adjacent medium ink droplets. Thus, as an image is formed, rasters having the large dots which resulted from the joining of adjacent medium dots, and rasters having the medium dots which resulted from the joining of adjacent small dots, alternate in terms of the secondary scan direction. Therefore, this structural arrangement for an ink jet recording head is likely to cause an ink jet recording head to form images which are streaky and/or nonuniform.

Further, the occurrence of the above described problem is not limited to symmetrical recording heads. That is, the problem also occurs if an ink jet recording head, which is not symmetrical in nozzle row arrangement, and which prints (jets ink) only when it is moved in a preset direction, is used to used to print a monochromatic image with the use of two or more rows of ink jetting nozzles among the large ink droplet jetting nozzle row, medium ink droplet jetting nozzle row, and small ink droplet jetting row.

In any of the abovementioned cases, a common liquid chamber for the nozzles for jetting medium ink droplets or a common liquid chamber for the nozzles for jetting small ink droplets, is necessary in addition to the abovementioned common liquid chamber for the nozzles for jetting the large ink droplets. Therefore, the employment of this structural arrangement makes it difficult to reduce an ink jet recording head in size.

SUMMARY OF THE INVENTION

The present invention was made to solve the problems described above. Thus, the primary object of the present invention is to provide an ink jet recording head capable of forming a high resolution image which does not suffer from the problems associated with the prior art.

According to an aspect of the present invention, there is provided an ink jet head movable in a main scan direction, comprising:

a first group of ejection outlet arrays disposed at one side of a common liquid chamber and including a first ejection outlet array and a second ejection outlet array disposed adjacent to the first ejection outlet array, wherein amounts of liquid ejection of ejection outlets of the first ejection outlet array and amounts of liquid ejection of ejection outlets of the second ejection outlet array are different from each other, and the ejection outlets of the first ejection outlet array and the ejection outlets of the second ejection outlet array are disposed in a staggered arrangement;

a second group of ejection outlet arrays disposed at the other side of the common liquid chamber and including a common ejection amount ejection outlet array having ejection outlets for ejecting an amount of the liquid which is the same as one of the amounts of liquid ejection of the ejection outlets of the first ejection outlet array and the second ejection outlet array and including a non-common ejection amount ejection outlet array disposed adjacent to the common ejection amount ejection outlet array and having ejection outlets for ejecting an amount of the liquid which is different from the amounts of liquid ejection of the ejection outlets of the first ejection outlet array group, wherein the ejection outlets of the common ejection amount ejection outlet array and ejection outlets of the non-common ejection amount ejection outlet array are disposed in a staggered arrangement;

a plurality of sets each comprising the first ejection outlet array group and the second ejection outlet array group, wherein the sets are provided for each of at least cyan and magenta colors, respectively;

wherein the ejection outlets of the second ejection outlet array group are disposed with deviation of ½ of an interval at which the ejection outlets of the first ejection outlet array group are arranged, relative to the ejection outlets of the first ejection outlet array group, wherein in the non-common ejection amount ejection outlet arrays in different ones of sets for the same color, are disposed with deviation of ½ of an interval at which the ejection outlets of the non-common ejection amount ejection outlet arrays in the different ones of sets are arranged.

According to the present invention, it is possible to solve the problem which an ink jet recording head having multiple rows of ink droplet jetting nozzles, which are different (large, medium, and small) in the size of the ink droplet they jet, more specifically, the problem that if any of the ink droplet jetting nozzle rows becomes deviant in ink droplet landing spot, the adjacent dots in this row are likely to be formed joined, and therefore, a grainy image is likely to be formed.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the first embodiment of the present invention will be described with reference to appended drawings.

Embodiment 1

Figure 1B:
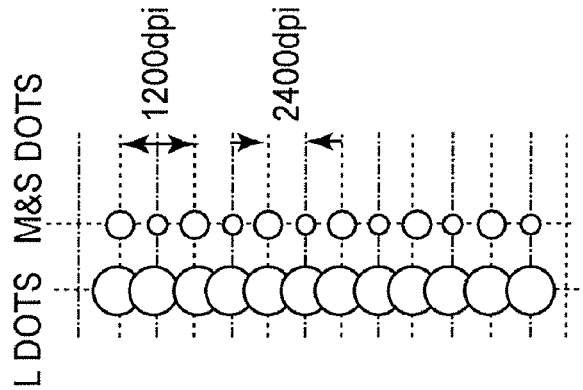
FIG. 1B is a schematic drawing of the pattern in which dots are formed by the head in the first embodiment.
Figure 1A:
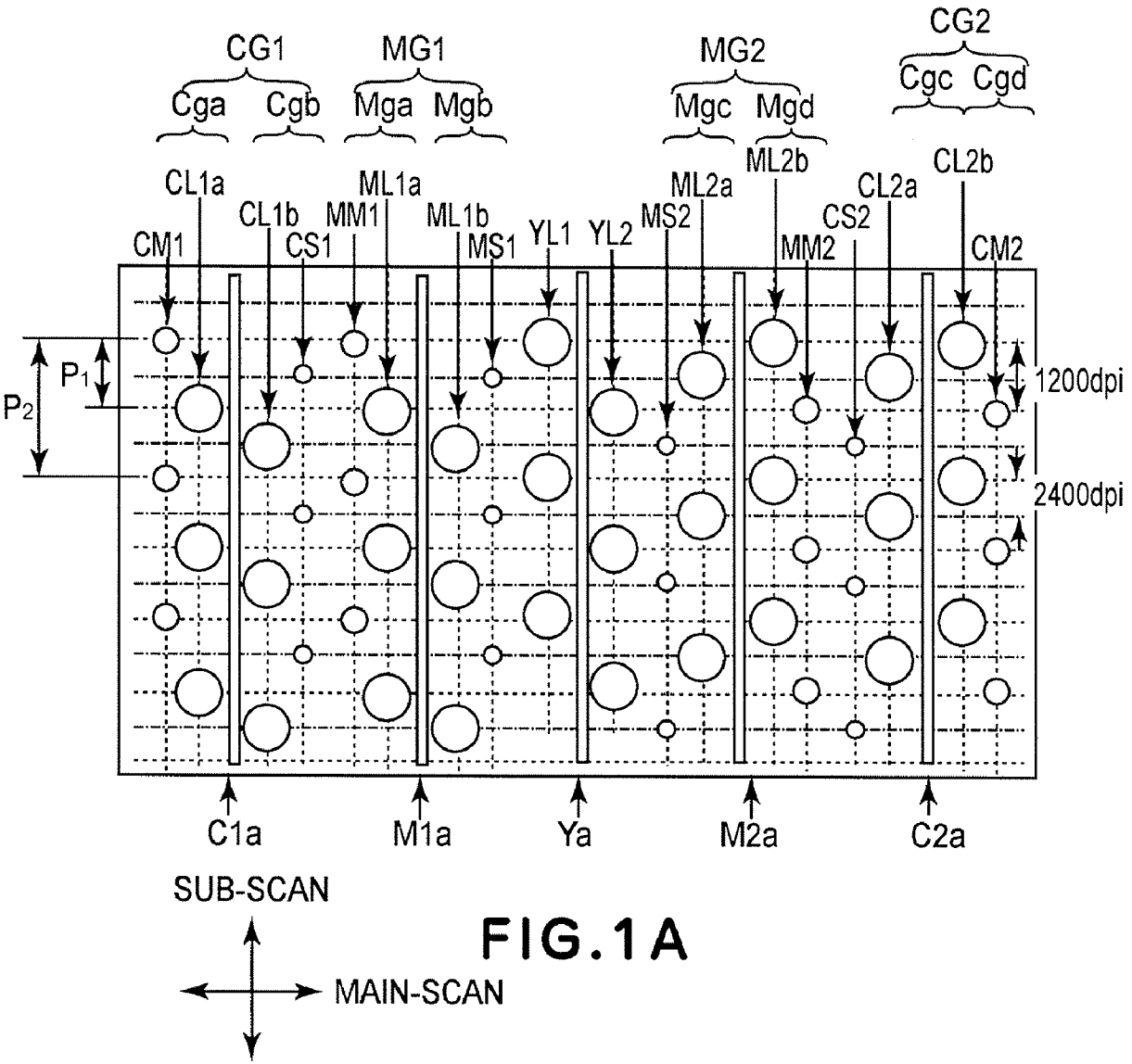
FIG. 1A is a schematic drawing of the ink jet recording head in the first embodiment of the present invention, showing the nozzle arrangement of the head.

The structure of the ink jet recording apparatus in this embodiment is shown in FIGS. 1A and 1B.

FIG. 1A is a schematic plan view of the ink jet recording head in this embodiment, as seen from the side where the ink jetting nozzles are. FIG. 1B is a schematic drawing of the adjacent two rows of dots formed on a sheet of paper, as a recording medium, with the use of the ink jet recording head in this embodiment.

In this embodiment of present invention, recording is made by moving the head in the direction (primary scan direction) intersectional (perpendicular) to the direction in which recording medium is moved.

First, what are designated by the various referential symbols in the drawings will be described. The head in this embodiment uses three inks different in color, which are cyan (C), magenta (M), and yellow (Y) inks. The head has multiple ink jetting nozzle rows, which are different in nozzle size: large (L), medium (M), and small (S). The amounts by which ink is jetted per jetting through the large, medium, and small ink jetting nozzles are 2.8 pl, 1.4 pl, and 0.6 pl, respectively. Referring to FIG. 1A, the circles in the drawing represent the ink jetting nozzles, one for one, and the long and narrow rectangles in the drawing represent the common liquid chambers, one for one, from which ink is supplied to the ink jetting nozzles. The first character in each of the referential symbols which designate the ink jetting nozzle rows or groups represents ink color, and the second character in each referential symbol represents nozzle size (amount by which ink is jetted). The first character in each of the referential symbols which designate common liquid chambers, one for one, represents ink color.

Designated by referential symbols CL1*a*, CL1*b*, CL2*a*, and CL2*b* are rows of ink jetting nozzles which jet large cyan ink droplets. That is, they designate the rows of the ink jetting nozzles which jet the largest amount of ink per jetting. Designated by referential symbols CM1 and CM2 are rows of ink jetting nozzles which jet medium cyan ink droplets. Designated by referential symbols CS1 and CL2 are rows of ink jetting nozzles which jet small cyan ink droplets. That is, they designate the rows of the ink jetting nozzles which jet the smallest amount of ink per jetting.

Designated by referential symbols ML1*a*, ML1*b*, ML2*a*, and ML2*b* are rows of ink jetting nozzles which jet large magenta ink droplets. Designated by referential symbols MM1 and MM2 are rows of ink jetting nozzles which jet medium magenta ink droplets. Designated by referential symbols MS1 and MS2 are rows of ink jetting nozzles which jet small magenta ink droplets.

Designated by referential symbols YL1 and Yl2 are rows of ink jetting nozzles which jet large yellow ink droplets. In this embodiment, two arrays are provided for yellow, but only one array may be enough for yellow, or the same arrangement as cyan or magenta arrays may be employed.

Designated by a referential symbol C1*a* is a common liquid chamber for supplying CL1*a*, CL1*b*, CM1, and CS1 with ink. Designated by a referential symbol C2*a* is a common liquid chamber for supplying CL2*a*, CL2*b*, CM2, and CS2 with ink.

Designated by a referential symbol M1*a* is a common liquid chamber for supplying ML1*a*, ML1*b*, MM1, and MS1 with ink. Designated by a referential symbol M2*a* is a common liquid chamber for supplying ML2*a*, ML2*b*, MM2, and MS2 with ink.

Designated by a referential symbol Ya is a common liquid chamber for supplying YL1 and YL2 with ink.

Listing from the left side of FIG. 1A, the ink jet recording head in FIG. 1A has a first cyan ink jetting section, a first magenta ink jetting section, a yellow ink jetting section, a second magenta ink jetting section, and a second cyan ink jetting section. In terms of the primary scan direction, the first and second cyan ink jetting sections are symmetrically positioned with respect to the yellow ink jetting section, and so are the first and second magenta ink jetting sections. Although the drawing shows only the structures of the recording heads for the cyan, magenta, and yellow inks, there is a black ink jetting ink jet recording head, which is located next to an outside or both outsides of the ink jet recording head shown in FIG. 1A.

In the case of the cyan ink jetting section and magenta ink jetting section, the row of the large ink jetting nozzles and the row of the medium ink jetting nozzles are positioned on one side of the common liquid chamber, and the other row of large ink jetting nozzles and the row of the small ink jetting nozzles are positioned on the other side of the common liquid chamber. In this embodiment, the resolutions (nozzle pitches) of the large, medium, and small ink droplet jetting nozzle rows are all equivalent to 600 dpi. Thus, the combined nozzle pitch (equivalent to image resolution) of the large and medium ink droplet jetting nozzle rows is equivalent to 1,200 dpi, and the combined nozzle pitch (equivalent to dot resolution) of the large and small ink droplet jetting nozzle rows is equivalent to 1,200 dpi.

Achieving a resolution of no less than 600 dpi by placing only large ink droplet jetting nozzles on only one side of the common liquid chamber is difficult. However, the ink passage for providing the medium ink droplet jetting nozzles, and the ink passage for providing the small ink droplet jetting nozzle with ink, can be positioned between the adjacent two large ink droplet jetting nozzles. In this embodiment, therefore, a resolution of no less than 600 is achievable by placing the combination of a row of large ink droplet jetting nozzles and a row of medium ink droplet jetting nozzles, on one side of the common liquid chamber, and the combination of a row of large ink droplet jetting nozzles and a row of small ink droplet jetting nozzle, on the other side of the common liquid chamber.

Further, in terms of the direction in which ink jetting nozzles are aligned in each row, the ink droplet jetting nozzles on one side of the common liquid chamber, that is, the nozzles in the large ink droplet jetting nozzle row and the nozzles in the medium ink droplet jetting nozzle row, are offset from those on the other side of the common liquid chamber, that is, the nozzles in the large ink droplet jetting nozzle row and the nozzles of the small ink droplet jetting nozzle row, by ½ the pitch at which the ink jetting nozzles are positioned on each side of the common liquid chamber. In this embodiment, they are offset in the secondary scan direction by 2,400 dpi.

Hereafter, the above described ink jetting nozzle arrangement will be concretely described using the referential symbols in the drawings.

A referential symbol Cga designates a first cyan ink jetting nozzle row subgroup, which is the combination of the ink jetting nozzle rows on the left side of the common liquid chamber C1*a*. A referential symbol Cgb designates a second cyan ink jetting nozzle row subgroup, which is the combination of the ink jetting nozzle rows on the right side of the common liquid chamber C1*a*. The first and second cyan ink jetting nozzle row subgroups Cga and Cgb make up the cyan ink jetting nozzle row group CG1.

The first cyan ink droplet jetting nozzle row subgroup Cga is made up of the medium cyan ink droplet jetting nozzle row CM1, and the large cyan ink droplet jetting nozzle row CL1*a* which is positioned next to the medium cyan ink droplet jetting nozzle row CM1 so that the nozzles in the nozzle row subgroup Cga are arranged with equal intervals, in zig-zag pattern in terms of the secondary scan direction. The second cyan ink droplet jetting nozzle row subgroup Cgb is made up of the large cyan ink droplet jetting nozzle row CL1*b*, and the small cyan ink droplet jetting nozzle row CS1 which is positioned next to the large cyan ink droplet jetting nozzle row CL1*b* so that the nozzles in the second cyan ink droplet jetting nozzle row subgroup Cgb are arranged with uniform intervals, in a zig-zag pattern, in terms of the secondary scan direction.

Also in terms of the secondary scan direction, the nozzles in the second cyan ink droplet jetting row subgroup Cgb, and the nozzles in the first cyan ink droplet jetting row subgroup Cga, are arranged so that each nozzle in the second cyan ink droplet jetting row subgroup Cgb is offset relative to the corresponding nozzle in the second cyan ink droplet jetting row subgroup Cga, by ½ the pitch (P1 in FIG. 1) at which the ink droplet jetting nozzles (large ink droplet jetting nozzles and medium ink droplet jetting nozzles) in the second cyan ink droplet jetting row subgroup Cga are arranged.

A referential symbols Mga designates a first magenta ink jetting nozzle row subgroup, which is the combination of the two rows of ink droplet jetting nozzles on the left side of the common liquid chamber M1*a*. A referential symbols Mgb designates a second magenta ink jetting nozzle row subgroup, which is the combination of the two rows of ink jetting nozzles on the right side of the common liquid chamber M1*a*. The first and second magenta ink jetting nozzle row groups Mga and Mgb make up the cyan ink jetting nozzle row group MG1.

The first ink droplet jetting nozzle row subgroup Mga is made up of the medium magenta ink droplet jetting nozzle row MM1, and the large magenta ink droplet jetting nozzle row ML1*a* which is positioned next to the medium magenta ink droplet jetting nozzle row MM1 so that the nozzles in the first magenta ink droplet jetting nozzle row subgroup Mga are arranged in a zig-zag pattern in terms of the secondary scan direction. The second magenta ink droplet jetting nozzle row subgroup Mgb is made up of the large magenta ink droplet jetting nozzle row ML1*b*, and the small magenta ink droplet jetting nozzle row MS1 which is positioned next to the large magenta ink droplet jetting nozzle row ML1*b* so that the nozzles in the second magenta ink droplet jetting nozzle row subgroup Mgb are arranged in a zig-zag pattern, with uniform intervals, in terms of the secondary scan direction.

In terms of the secondary scan direction, the nozzles in the second magenta ink droplet jetting row subgroup Mgb, and the nozzles in the first magenta ink droplet jetting row group Mga, are arranged so that each nozzle in the second magenta ink droplet jetting row subgroup Mgb is offset relative to the corresponding nozzle in the first magenta ink droplet jetting row subgroup Mga by ½ the pitch (P1 in FIG. 1) at which the nozzles in the first magenta ink droplet jetting nozzle row subgroup Mga are arranged.

Designated by a referential symbol Mgc is a first magenta ink droplet jetting nozzle row subgroup, which is on the left side of the common liquid chamber M2*a*, and designated by a referential symbol Mgd is a second magenta ink droplet jetting nozzle row subgroup, which is on the right side of the common liquid chamber M2*a*. Further, the first and second magenta ink droplet jetting nozzle row subgroups Mgc and Mgd make up a magenta ink droplet jetting nozzle row group MG2.

The first ink droplet jetting nozzle row subgroup Mga is made up of the small magenta ink droplet jetting nozzle row MS2, and the large magenta ink droplet jetting nozzle row ML2*a* which is positioned next to the small ink droplet jetting row MS2 so that the nozzles in the first ink droplet jetting nozzle row subgroup Mga are arranged in a zig-zag pattern, with equal intervals, in terms of the secondary scan direction.

In terms of the secondary scan direction, the nozzles in the second magenta ink droplet jetting row subgroup Mgd, and the nozzles in the second magenta ink droplet jetting row subgroup Mgc, are arranged so that each nozzle in the second magenta ink droplet jetting nozzle row subgroup Mgd is offset relative to the corresponding nozzle in the first magenta ink droplet jetting nozzle row subgroup Mgc by ½ the pitch (P1 in FIG. 1) at which the first magenta ink droplet jetting nozzle row subgroup Mgc are arranged.

Designated by a referential symbol Cgc is a first cyan ink droplet jetting nozzle row subgroup, which is on the left side of the common liquid chamber C2*a*, and designated by a referential symbol Cgd is a second cyan ink droplet jetting nozzle row subgroup, which is on the right side of the second liquid chamber C2*a*. The first and second cyan ink droplet jetting nozzle row subgroups Cgc and Cgd make up a cyan ink droplet jetting nozzle row group CG2.

The first cyan ink droplet jetting nozzle row subgroup Cgc is made up of the small cyan ink droplet jetting nozzle row CS2 and large cyan ink droplet jetting nozzle row CL2. In terms of the secondary scan direction, the nozzles in the row CS2 and the nozzles in the row CL2 are aligned so that the nozzles in the first cyan ink droplet jetting nozzle row subgroup Cgc are arranged in a zig-zag pattern, with the equal intervals. The second cyan ink droplet jetting nozzle row subgroup Cgd is made up of the large cyan ink droplet jetting nozzle row CL2*b*, and medium cyan ink droplet jetting nozzle row CM2 which is placed next to the nozzle row CL2*b*. In terms of the secondary scan direction, the nozzles in the row CS2 and the nozzles in the row CL2 are aligned so that the nozzles in the first cyan ink droplet jetting nozzle row subgroup Cgc are arranged in a zig-zag pattern, with the equal intervals.

In terms of the secondary scan direction, the nozzles in the second cyan ink droplet jetting nozzle row subgroup Cgd and the nozzles in the first cyan ink droplet jetting nozzle row group Cgc are aligned so that each cyan ink droplet jetting nozzle in the subgroup Cgd is offset relative to the corresponding cyan ink droplet jetting nozzle in subgroup Cgc by ½ the pitch at which the cyan ink droplet jetting nozzles are arranged in subgroup Cgc.

As for the positional relationship between the rows of nozzles for jetting large ink droplets of the same color on one side, and the other side, of the common liquid chamber Ya, the positional relationship between the rows of nozzles for jetting medium ink droplets of the same color on one side, and the other side, of the common liquid chamber Ya, and the positional relationship between the rows of nozzles for jetting small ink droplets of the same color on one side, and the other side, of the common liquid chamber Ya, are such that, in terms of the secondary scan direction, the large ink droplet jetting nozzles on one side of the common liquid chamber Ya are offset relative to the corresponding large ink droplet jetting nozzles on the other side, by ½ the pitch at which the large ink droplet jetting nozzles are aligned in each row of the large ink droplet jetting row; the medium ink droplet jetting nozzles on one side of the common liquid chamber Ya are offset relative to the corresponding medium ink droplet jetting nozzles on the other side by ½ the pitch at which the medium ink droplet jetting nozzles are aligned in each row of the medium ink droplet jetting nozzle row; and the small ink droplet jetting nozzles on one side of the common liquid chamber Ya are offset relative to the corresponding small ink droplet jetting nozzles on the other side by ½ the pitch at which the small ink droplet jetting nozzles are aligned in each small ink droplet jetting nozzle row. Incidentally, hereafter, the combination of the two rows of large ink droplet jetting nozzles in each ink droplet jetting nozzle row group will be referred to as uniform (large) nozzle row subgroup, and the combination of the two rows of ink droplet jetting nozzles in each ink droplet nozzle row group, which are different in the amount by which each nozzle jets ink, will be referred to as nonuniform (middle and small) nozzle row subgroup. Then, the nozzles in one of the nonuniform nozzle row subgroups are offset relative to the nozzles in the other nonuniform nozzle row subgroup, which are the same in ink color and ink droplet size, by ½ the pitch.

Incidentally, in this embodiment, the ink jetting nozzles in each ink jetting nozzle row of the recording head are aligned at a pitch of 600 nozzle per inch (Pitch P2 in FIG. 1), which is equivalent to 600 "dpi". Thus, the statement that ink jetting nozzles in one ink jetting nozzle row are offset by ½ the pitch at which the nozzles are aligned in each row means that the ink jetting nozzles in one row are offset by an equivalence of 1,200 dpi from the corresponding ink jetting nozzle in the other row.

On the other hand, the recording head in this embodiment is structured so that the above described ink droplet jetting nozzle row subgroup is made up of two ink droplet jetting nozzle rows, and also, so that the nozzles in one of the two ink droplet jetting nozzle rows are offset from the corresponding nozzles in the other ink droplet jetting nozzle row, in the secondary scan direction, by ½ the pitch at which the nozzles are aligned in both rows. Thus, the nozzles in nozzles row subgroup are positioned in a zig-zag pattern in secondary scan direction. Therefore, the nozzles in each ink jetting nozzle row subgroup are aligned at a pitch (pitch P1 in FIG. 1) equivalent to 1,200 "dpi". Therefore, the statement that ink jetting nozzles in one ink jetting nozzle row subgroup are offset from the corresponding ink droplet jetting nozzles in another ink droplet jetting nozzle row subgroup by ½ the pitch at which the nozzles are aligned in each ink jetting nozzle row subgroup means that the ink jetting nozzles in one ink jetting nozzle row subgroup are offset by a pitch equivalent to 2,400 "dpi" from the corresponding ink jetting nozzle in the other ink jetting nozzle row subgroup.

That is, ½ the pitch in each ink jetting nozzle row means ½ the pitch P2, and ½ the pitch in each ink jetting nozzle row subgroup means ½ the pitch P1.

Next, the arrangements of the ink jetting nozzles, nozzle rows, nozzle row subgroups, and nozzle row groups will be more concretely described using the referential symbols in the drawings.

The ink jetting nozzles in the medium ink droplet jetting nozzle row CM1 of the cyan ink droplet jetting nozzle row group CG1 are offset relative to the ink jetting nozzles in the medium ink droplet jetting nozzle row CM2 of the cyan ink droplet jetting nozzle row group CG2, by ½ the pitch. That is, the medium cyan ink droplet jetting nozzles on one side of the common liquid chamber Ya are offset by ½ the pitch (equivalent to 1,200 "dpi" in this embodiment) relative to the corresponding medium cyan ink droplet jetting nozzles on other side of the common liquid chamber Ya.

The ink jetting nozzles in the small ink droplet jetting nozzle row CS1 of the cyan ink droplet jetting nozzle row group CG1 are offset by ½ the pitch relative to the ink jetting nozzles in the small ink droplet jetting nozzle row CS2 of the cyan ink droplet jetting nozzle row group CG2. That is, the small cyan ink droplet jetting nozzles on one side of the common liquid chamber Ya are offset by ½ the pitch (equivalent to 1,200 "dpi" in this embodiment) from the corresponding small cyan ink droplet jetting nozzles on other side of the common liquid chamber Ya.

Similarly, the ink jetting nozzles in the medium ink droplet jetting nozzle row MM1 of the magenta ink droplet jetting nozzle row group MG1 are offset by ½ the pitch relative to the ink jetting nozzles in the medium ink droplet jetting nozzle row MM2 of the magenta ink droplet jetting nozzle row group MG2. That is, the medium magenta ink droplet jetting nozzles on one side of the common liquid chamber Ya are offset by ½ the pitch relative to the corresponding medium magenta ink droplet jetting nozzles on other side of the common liquid chamber Ya.

The ink jetting nozzles in the small ink droplet jetting nozzle row subgroup MS1 of the magenta ink droplet jetting nozzle row group MG1 are offset by ½ the pitch from the ink jetting nozzles in the small ink droplet jetting nozzle row MS2 of the magenta ink droplet jetting nozzle row group MG2. That is, the small magenta ink droplet jetting nozzles on one side of the common liquid chamber Ya are offset by ½ the pitch relative to the corresponding small magenta ink droplet jetting nozzles on other side of the common liquid chamber Ya.

Shown in FIG. 1B is the positioning of the ink dots formed by the ink droplets jetted by the recording head structured as described above. The large dots are the dots formed by the large liquid droplets which were jetted from the large ink droplet jetting nozzles and landed on the recording medium, and the medium dots are the dots formed by the medium liquid droplets which were jetted from the medium ink droplet jetting nozzles and landed on the recording medium. The small dots are the dots formed by the small ink droplets which were jetted from the small ink droplets and landed on the recording medium. In FIG. 1B, the combination of the row of medium dots and row of small dots is drawn offset from the row of large dots in the primary scan direction, for the ease of understanding.

In terms of the secondary scan direction, the resolution of the large dots is 2,400 dpi, which is equivalent to four times the number of large ink droplet jetting nozzles per inch in each row of large ink droplet jetting nozzles. The resolution of the medium dots is 1,200 dpi, which is equivalent to twice the number of medium ink droplet jetting nozzles per inch in each row of medium ink droplet jetting nozzles, and the resolution of the small dots is also 1,200 dpi, which is equivalent to twice the number of small ink droplet jetting nozzles per inch in each row of small ink jet droplet jetting nozzles. The resolution of the combination of the medium dots and small dots is 2,400 dpi.

With the employment of the ink jet recording head structure in this embodiment, it is possible to form medium dots and small dots, with equal intervals, at a higher resolution. Further, it is possible to form large dots, with equal intervals, at a resolution equivalent to four times the number of nozzles, per inch, in a row of large ink droplet jetting nozzles.

Thus, the ink jet recording head structure in this embodiment can increase the AF (ratio of portion of surface of sheet of paper covered with dots), substantially reducing the possibility that streaky images will be formed. Further, the medium dots and small dots are formed with uniform intervals. Therefore, the problem that the irregularity in the ink droplet landing on recording medium, irregularity in head movement in the primary scan direction, and/or irregularity in recording sheet conveyance causes adjacent medium dots and adjacent small dots to be formed joined is less likely to occur. Therefore, the ink jet recording head structure in this embodiment can prevent an ink jet recording head from forming images which are unintendedly grainier. Thus, the structure enables an ink jet recording apparatus to form high quality images with smaller number of passes. Therefore, the structure makes it possible to provide an ink jet recording apparatus which is capable of printing high quality images at a substantially high speed than an ink jet recording apparatus in accordance with the prior art.

Further, the ink jet recording head structure in this embodiment makes unnecessary the common liquid chamber dedicated to small ink droplet jetting nozzles or medium ink droplet jetting nozzles, making it thereby possible to reduce the amount of space which an ink jet recording head is required for nozzle placement. Thus, the structure makes it possible to substantially reduce an ink jet recording head in size and cost.

Further, in the case of the ink jet recording head structure in this embodiment, the small ink droplet jetting nozzles are in connection with the same common liquid chamber as the common liquid chamber with which the large ink droplet jetting nozzles and the medium ink droplet jetting nozzles are in connection. Obviously, the present invention is compatible to an ink jet recording head structured so that the small ink droplet jetting nozzles are in connection with a common liquid chamber different from the common liquid chamber with which the large ink droplet jetting nozzles and the medium ink droplet jetting nozzles are in connection. Shown in FIG. 2A is an example of such an ink jet recording head.

The common liquid chamber C1*a* supplies the large ink droplet jetting nozzle row CL1*a*, large ink droplet jetting nozzle row CL1*b*, and medium ink droplet jetting nozzle row CM1 with ink, and the common liquid chamber C1*b* supplies small ink droplet jetting nozzle row CS1.

The common liquid chamber M1*a* supplies the large ink droplet jetting nozzle row ML1*a*, large ink droplet jetting nozzle row ML1*b*, and medium ink droplet jetting nozzle row MM1 with ink, and the common liquid chamber M1*b* supplies small ink droplet jetting nozzle row MS1 with ink.

The common liquid chamber C2*a* supplies the large ink droplet jetting nozzle row CL2*a*, large ink droplet jetting nozzle row CL2*b*, and medium ink droplet jetting nozzle row CM2 with ink, and the common liquid chamber C2*b* supplies small ink droplet jetting nozzle row CS2.

The common liquid chamber M2*a* supplies the large ink droplet jetting nozzle row ML2*a*, large ink droplet jetting nozzle row ML2*b*, and medium ink droplet jetting nozzle row MM2 with ink, and the common liquid chamber M2*b* supplies small ink droplet jetting nozzle row MS2 with ink.

This structural arrangement makes it possible to widen the ink passages for supplying ink from the common liquid chamber to small ink droplet jetting nozzles, and therefore, makes it possible to reduce the length of time necessary to refill the nozzles with ink. Thus, this structural arrangement makes it possible to increase the frequency with which small ink droplets can be jetted, making it therefore possible to print at a substantially higher speed than an ink jet recording head in accordance with the prior art.

Figure 2B:
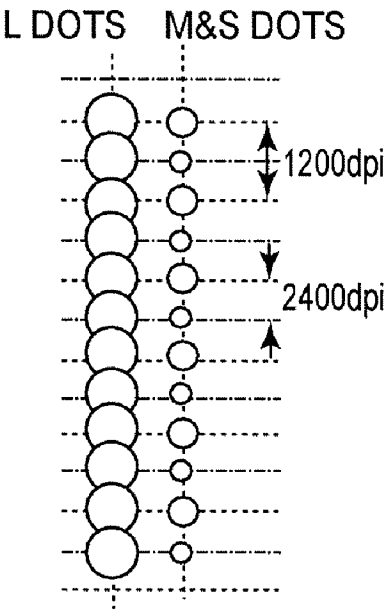
FIG. 2B is a schematic drawing of the pattern in which dots are formed by the modified version of the head in the first embodiment.
Figure 2A:
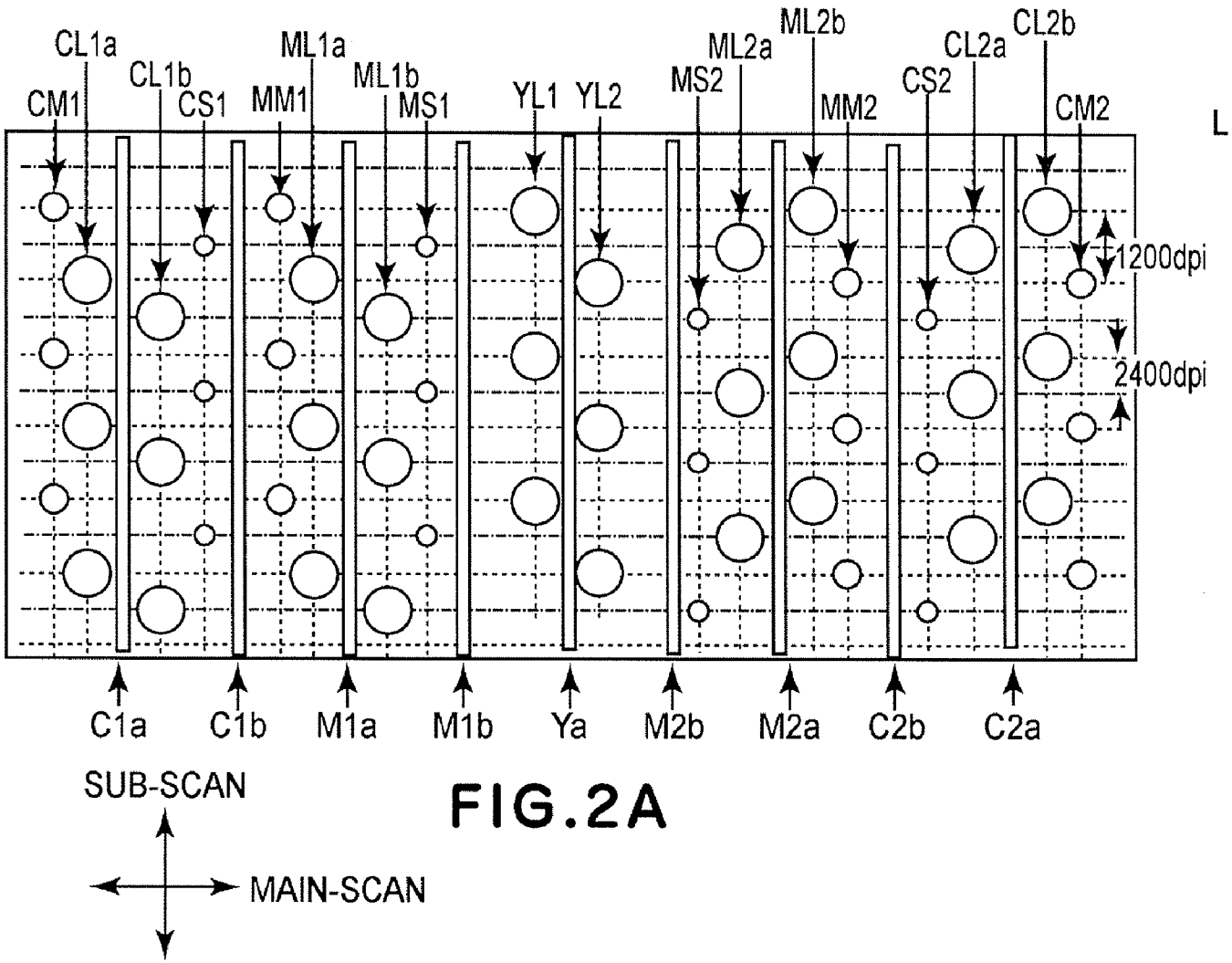
FIG. 2A is a schematic drawing of a modified version of the ink jet recording head in the first embodiment of the present invention, showing the nozzle arrangement of the head.

Referring to FIG. 2B, also in the case of this structural arrangement, large dots are formed, with equal intervals, at a resolution of 2,400 dpi, which is equivalent to four times the number of ink droplet jetting nozzles per inch in each row of large ink droplet jetting nozzles, in terms of the secondary scan direction. Further, the medium dots are formed at a resolution of 1,200 dpi, which is equivalent to twice the number of medium ink droplet jetting nozzles per inch in each row of medium ink droplet jetting nozzles, and the small dots are formed also at a resolution of 1,200 dpi, which is equivalent to twice the number of small ink droplet jetting nozzles per inch in each row of small ink jet droplet jetting nozzles. Further, the combination of the medium dots and small dots are formed with equal intervals at a resolution of 2,400 dpi.

Further, not only may the small ink droplet jetting nozzles be connected to a common liquid chamber dedicated to the small ink droplet jetting nozzles, instead of the same common liquid chamber as that with which the large ink droplet jetting nozzles are in connection, in order to supply the small ink droplet jetting nozzle with ink, but also, the medium ink droplet jetting nozzles may be connected to a common liquid chamber dedicated to the medium ink droplet jetting nozzles, instead of the same common liquid chamber as that with which the large ink droplet jetting nozzles are in connection. Also in this case, it is possible to increase the frequency with which the medium ink droplets can be jetted. Therefore, this structural arrangement for an ink jet recording head also makes it possible to print at a substantially higher printing speed than the speed with which an ink jet recording head in accordance with the prior art can.

Embodiment 2

Figure 3B:
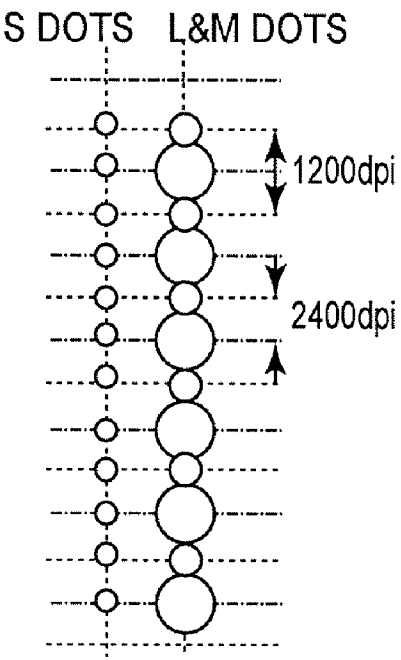
FIG. 3B is a schematic drawing of the pattern in which dots are formed by the head in the second embodiment.
Figure 3A:
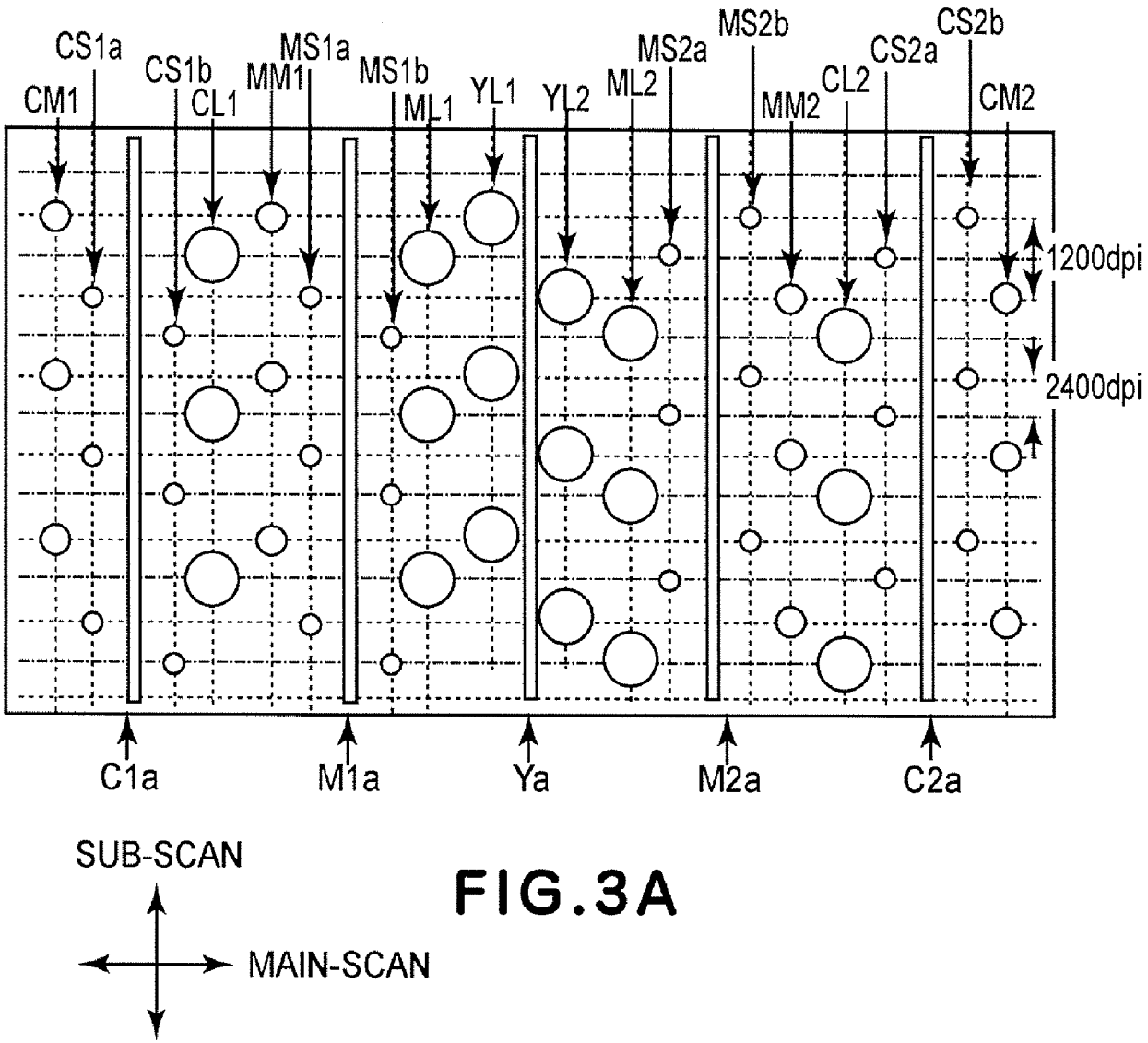
FIG. 3A is a schematic drawing of the ink jet recording head in the second embodiment of the present invention, showing the nozzle arrangement of the head.

The structure of the ink jet recording head in this embodiment is shown in FIG. 3. FIG. 3A is a plan view of the recording head in this embodiment, as seen from the ink droplet jetting side of the recording head. FIG. 3B is a schematic drawing of the dots formed on a sheet of paper by the recording head in this embodiment, showing the pattern in which the dots are formed by the recording head in this embodiment. Incidentally, the relationships among the referential symbols and the ink droplet jetting nozzles, nozzle rows, nozzle row subgroups, and nozzle row groups in this embodiment are the same as those in the first embodiment.

The ink jet recording head structure in this embodiment is different from that in the first embodiment in that this embodiment is reverse to the first embodiment in the positional relationship between a row of large ink droplet jetting nozzles and the corresponding row of small ink droplet jetting nozzles.

Referring to FIG. 1A, in the first embodiment, one row of large ink droplet jetting nozzles is located next to one side of the common liquid chamber, and the other row of the large ink droplet jetting nozzles is located next the other side of the common liquid chamber. Further, one row of medium ink droplet jetting nozzles and one row of small ink droplet jetting nozzles are located on the opposite sides of the two rows of large ink droplet jetting nozzles, one for one, from the common liquid chamber. Next, referring to FIG. 3A, in comparison, in this embodiment, one row of small ink droplet jetting nozzles is located next to one side of the common liquid chamber, and the other row of small ink droplet jetting nozzles is located next to the other side of the common liquid chamber. Further, one row of large ink droplet jetting nozzles and one row of medium ink droplet jetting nozzles are located on the opposite sides of the two rows of small ink droplet jetting nozzles, one for one, from the common liquid chamber.

The ink jet recording head structure in this embodiment will be concretely described with reference to the cyan ink jetting recording section. Referring to FIG. 1A, in the case of the head in the first embodiment, the large ink droplet jetting nozzle row CL1*a* is in the immediate adjacencies of one side of the common liquid chamber C1*a*, and the large ink droplet jetting nozzle row CL1*b* is in the immediate adjacencies of the other side of the common liquid chamber C1*a*. Further, the medium ink droplet jetting nozzle row CM1 is on the outward side of the large ink droplet jetting nozzle row CL1*a*, and the small ink droplet jetting nozzle row CS1 is on the inward side of the large ink droplet jetting nozzle row CL1*b*. In comparison, referring to FIG. 3A, in the case of the head in this embodiment, the small ink droplet jetting nozzle row CS1*a* is in the immediate adjacencies of the outward side of the common liquid chamber C1*a*, and the small ink droplet jetting nozzle row CS1*b* is in the immediate adjacencies of the inward side of the common liquid chamber C1*a*. Further, the medium ink droplet jetting nozzle row CM1 is on the outward side of the small ink droplet jetting nozzle row CS1*a*,and the large ink droplet jetting nozzle low CL1 is on the inward side of the small ink droplet jetting nozzle row CS1*b*. The details of the differences between FIG. 3A and FIG. 1A are as follows. That is, designated by referential symbols CS1*a*, CS1*b*, CS2*a*, and CS2*b* are rows of nozzles for jetting small cyan ink droplets, and designated by referential symbols CL1 and CL2 are rows of nozzles for jetting large cyan ink droplets. Designated by referential symbols MS1*a*, MS2*b*, MS2*a*, and MS2*b* are rows of nozzles for jetting small magenta ink droplets, and designated by referential symbols ML1 and ML2 are rows of nozzles for jetting large magenta ink droplets.

Referring to FIG. 3B, the ink jet recording head structural arrangement in this embodiment makes it possible to form small dots, with equal intervals, at a resolution of 2,400 dpi. It also makes it possible to form, in combination and with equal intervals, large dots and medium dots at a resolution of 2,400 dpi.

As described above, the structural arrangement, in this embodiment, for an ink jet recording head makes it possible to form small dots, with equal intervals, at a resolution higher than that in the first embodiment, making it therefore possible to print a high quality image at a higher speed than the speed at which the ink jet recording head in the first embodiment can.

Incidentally, in this embodiment, the ink jet recording head was structured so that the ink jetting nozzles of the small ink droplet jetting nozzle row on one side of the common liquid chamber are offset from the corresponding ink jetting nozzles of the small ink droplet jetting nozzle row on the other side of the common liquid chamber, by ½ the pitch at which the nozzles are aligned in each rows. However, the ink jet recording head structure in this embodiment is not intended to limit the present invention in scope.

For example, the present invention is also applicable to an ink jet recording head structured so that a row of medium ink droplet jetting nozzles is placed on one side of the common liquid chamber, and another row of medium ink droplet jetting nozzles is placed on the other side of the common liquid chamber, and also, so that the medium ink droplet jetting nozzles on one side of the common liquid chamber are offset, in the secondary scan direction, relative to the corresponding medium ink droplet jetting nozzles on the other side of the common liquid chamber, by ½ the pitch, just as effectively as it can to the ink jet recording head in this embodiment.

Embodiment 3

Figure 4B:
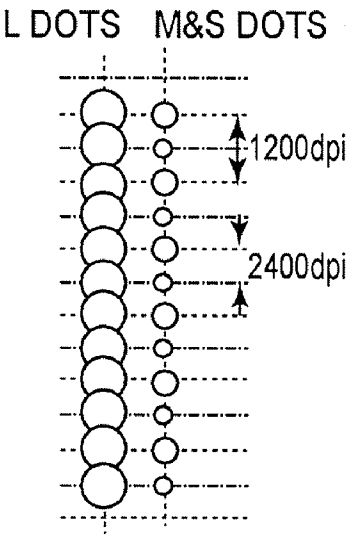
FIG. 4B is a schematic drawing of the pattern in which dots are formed by the head in the third embodiment.
Figure 4A:
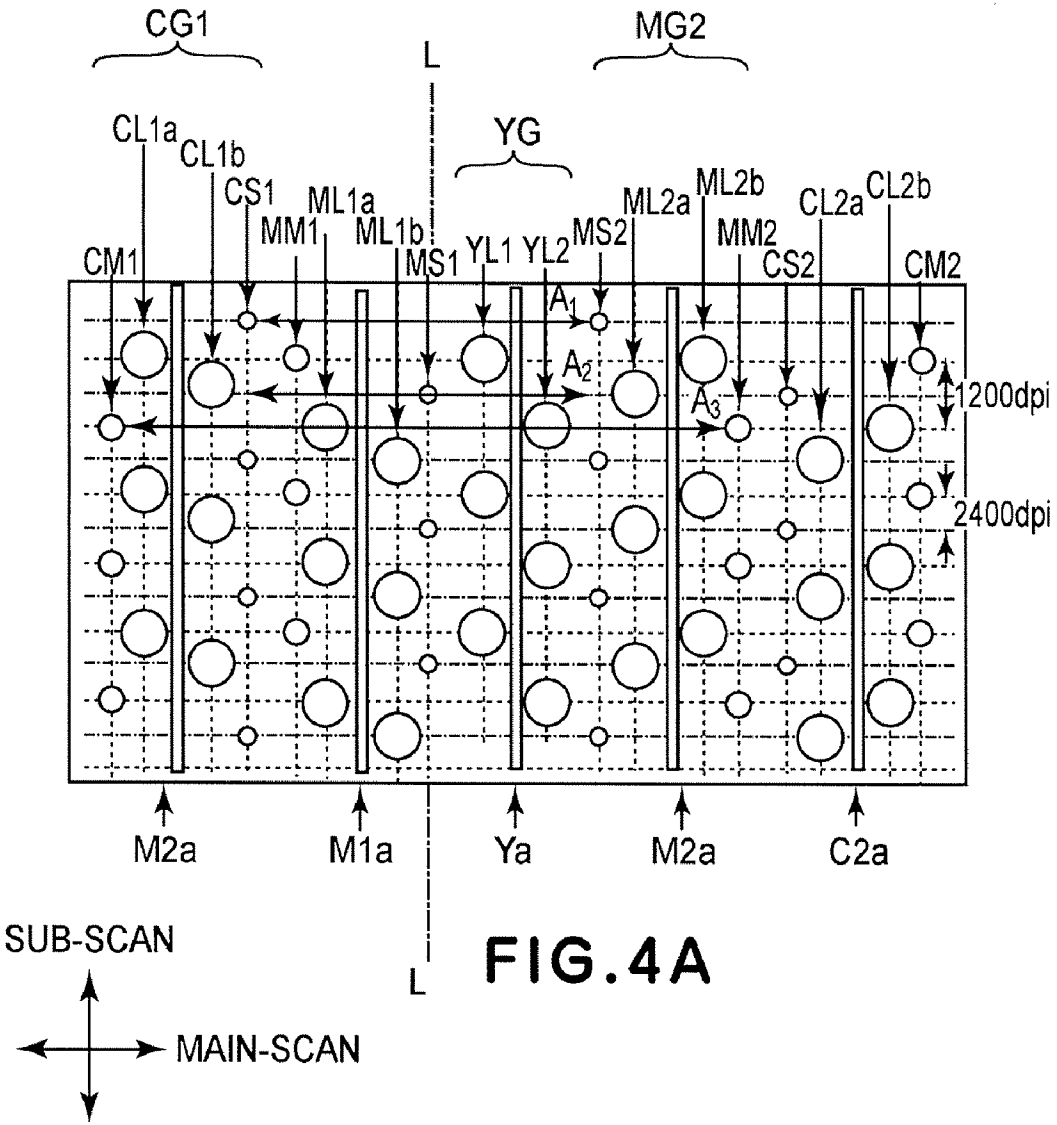
FIG. 4A is a schematic drawing of the ink jet recording head in the third embodiment of the present invention, showing the nozzle arrangement of the head.
Figure 5:
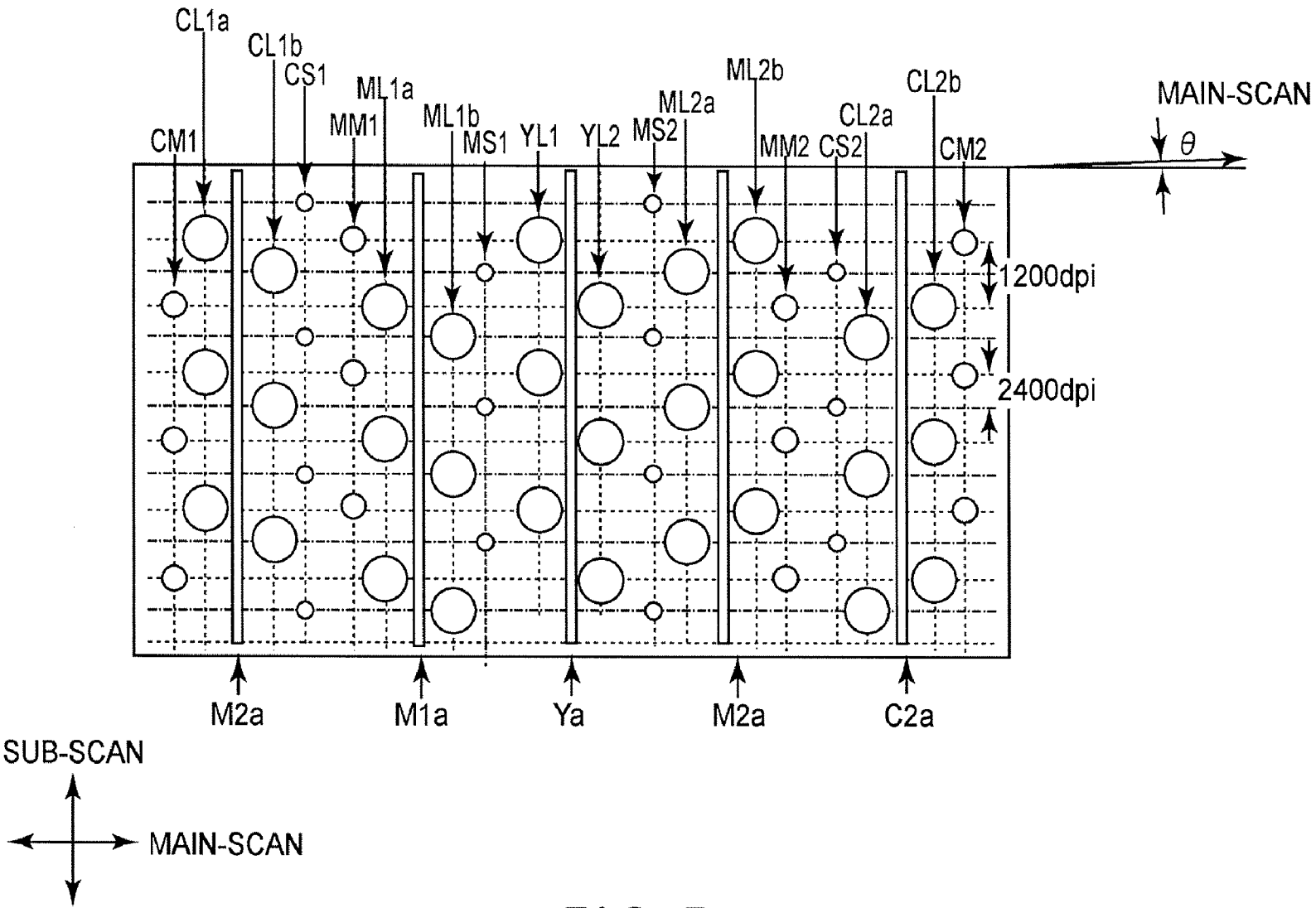
FIG. 5 is a schematic drawing of the ink jet recording head in the third embodiment, which is in the tilted state.
Figure 6:
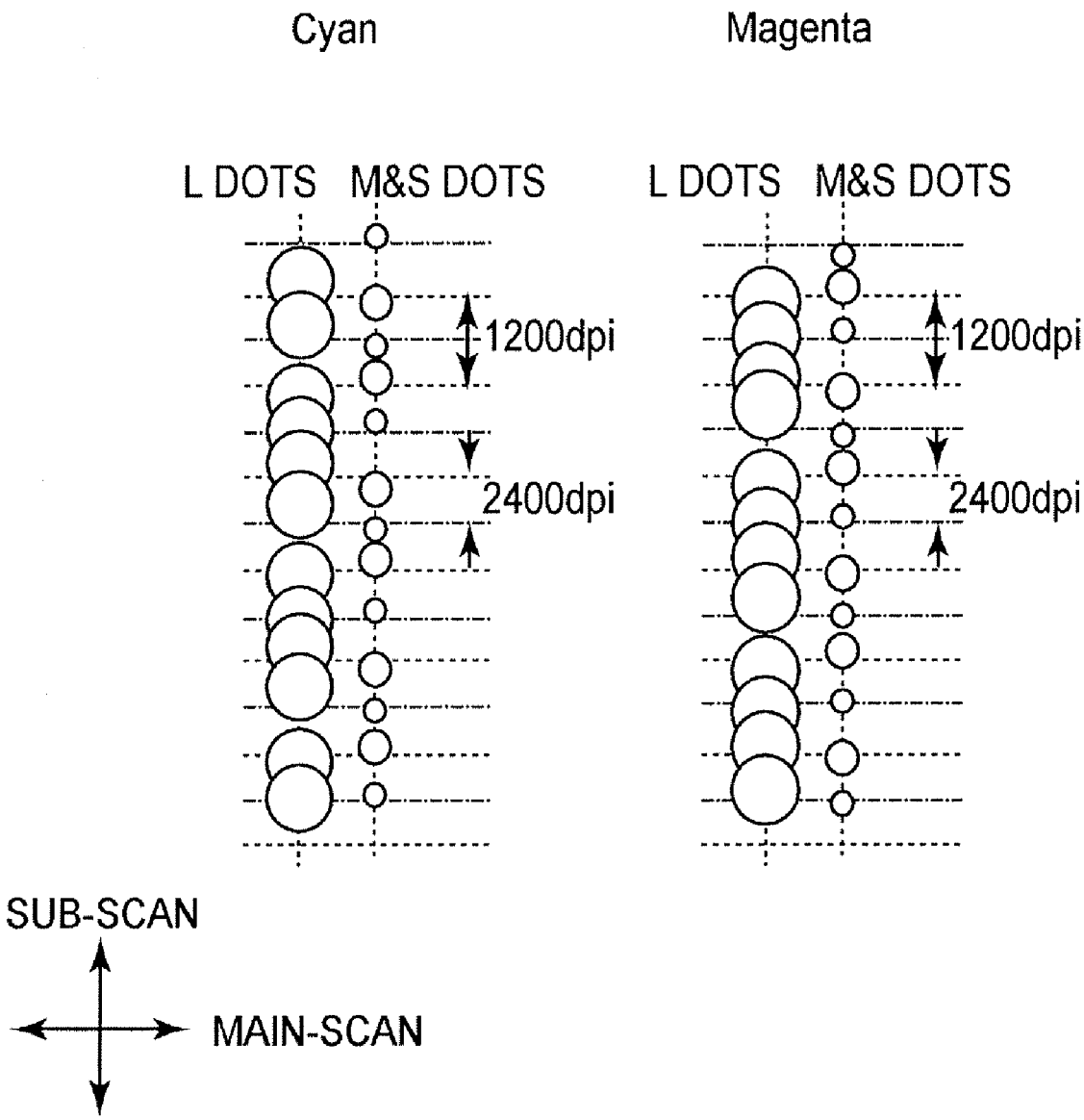
FIG. 6 is a schematic drawing of the pattern in which dots are formed by the ink jet recording head in the third embodiment when the head is in the tilted state.
Figure 7B:
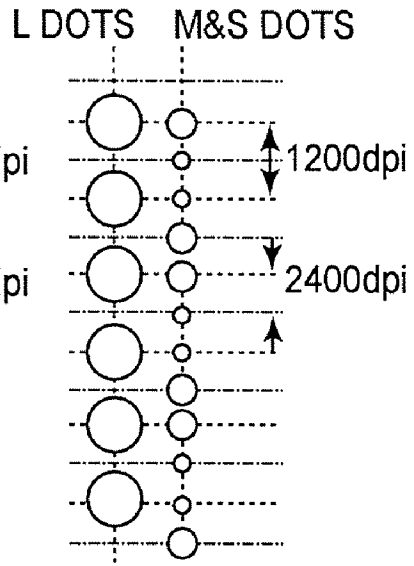
FIG. 7 is a schematic drawing of a typical ink jet recording head in accordance with the prior art, as a comparative example, showing the nozzle arrangement of the head.
Figure 7A:
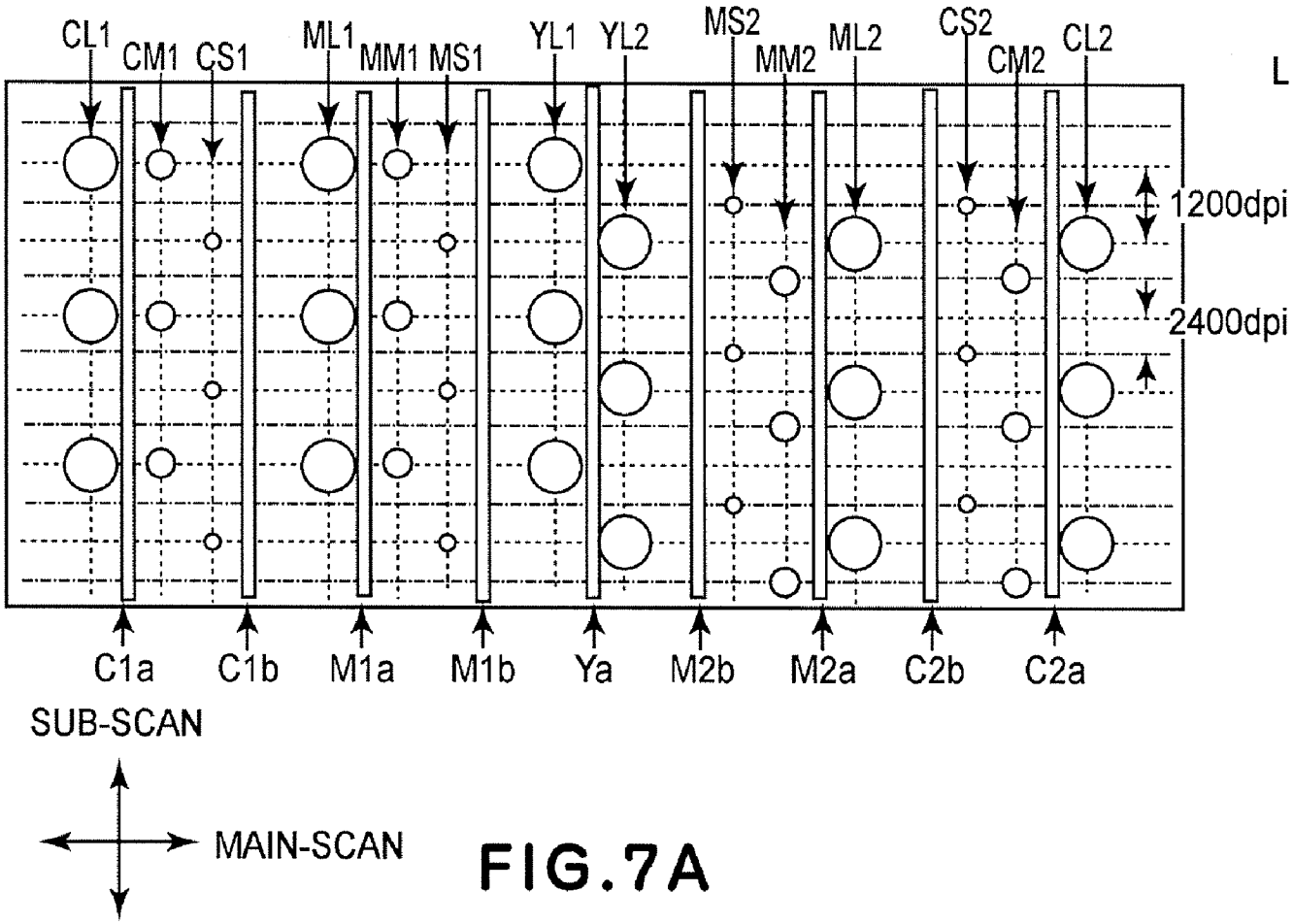

The structure of the ink jet recording head in this embodiment is shown in FIG. 4. FIG. 4A is a plan view of the recording head in this embodiment, as seen from the ink droplet jetting side of the recording head. FIG. 4B is a schematic drawing of the dots formed on a sheet of paper by the recording head in this embodiment, showing the pattern in which the dots are formed by the recording head in this embodiment. Incidentally, the relationships among the referential symbols and the ink jetting nozzles, nozzle rows, nozzle row subgroups, and nozzle row groups in this embodiment are the same as those in the first embodiment. FIG. 5 is a schematic plan view of the recording head, which is tilted by an angle of θ relative to the primary scan direction. FIG. 6 is a schematic drawing of the cyan and magenta dots formed by the recording head shown in FIG. 5, and shows the patterns in which the dots are formed.

In the case of the ink jet recording head in this embodiment, the nozzles are arranged so that the nozzles in the ink droplet jetting nozzle row which is on one side of the yellow ink droplet jetting section, and the corresponding nozzles in the ink droplet jetting nozzle row which is on the other side of the yellow ink droplet jetting section and is the same in ink droplet volume as the ink droplet jetting nozzle row on the first side, are the same in position in terms of the secondary scan direction, and also, so that the nozzle row in the ink droplet jetting nozzle row group which is on one side of the yellow ink droplet jetting section, and the corresponding nozzle rows in the ink droplet jetting nozzle row group which is on the other side of the yellow ink droplet jetting section and is the same in ink droplet volume as the ink droplet jetting nozzle row on the first side, are symmetrically positioned with respect to an arbitrary line, like the relationship between an object and the image of the object in a mirror.

That is, the two groups of cyan ink droplet jetting nozzle row subgroups are positioned on one side, and the other side, of the yellow ink droplet jetting row group, and the two groups of magenta ink droplet jetting nozzle row subgroups are also positioned one side, and the other side, of the yellow ink droplet jetting row group. Further, the ink droplet jetting nozzle rows on one side of the yellow ink droplet jetting row group, and the ink droplet jetting nozzle rows which are on the other side of the yellow ink droplet jetting row group and are equal in the ink droplet volume, are symmetrically positioned with respect to an arbitrary center line (cyan ink droplet jetting nozzles, and magenta ink droplet nozzles which are equal in ink droplet volume, are symmetrically positioned with respect to arbitrary center line).

More concretely, the medium ink droplet jetting nozzle row CM1 to the small ink droplet nozzle row CS1 and the small ink droplet nozzle row MS2 to medium ink droplet jetting nozzle row MM2 are symmetrically positioned with respect to an arbitrary line. The medium ink droplet jetting nozzle row MM1—small ink droplet jetting nozzle row MS1 are symmetrically positioned relative to the small ink droplet jetting nozzle row CS2—medium ink droplet jetting nozzle row CM2, respectively, with respect to an arbitrary line.

Next, the positioning of the ink jetting nozzles in this embodiment will be further described with reference to the cyan ink jetting nozzle row group CG1 and magenta ink droplet jetting nozzle group MG2.

The cyan ink droplet jetting row group CG1 is on one side of the yellow ink droplet jetting nozzle row group YG, and the magenta ink droplet jetting nozzle row group MG2 is on the other side of the yellow ink droplet jetting nozzle row group YG. Further, the groups CG1 and MG2 are symmetrically positioned with respect to an arbitrary center line L-L. The ink jetting nozzles of the small ink droplet jetting nozzle row CS1 and the ink jetting nozzles (indicated by arrow mark A1 in drawing) of the small ink droplet jetting nozzle row MS1 are symmetrically positioned with respect to the arbitrary center line L-L. The positional relationship between the ink jetting nozzle rows CS1 and MS1 is such that the ink jetting nozzles of the small ink droplet jetting nozzle row CS1 and the ink jetting nozzles of the small ink droplet jetting nozzle row MS1 may be said to match in position in terms of the secondary scan direction. The positional relationship between the ink jetting nozzles of the large ink droplet jetting nozzle row CL1*b* and those (designated by referential symbol A2 in drawing) of the large ink droplet jetting nozzle row ML2*a*, and the positional relationship between the ink jetting nozzles of the medium ink droplet jetting nozzle row CM1 and those (designated by referential symbol A3 in drawing) of medium ink droplet jetting nozzle row MM2, are the same as the positional relationship between the ink jetting nozzles in the small ink droplet jetting nozzle row CS1 and those of the small ink droplet jetting nozzle row MS1.

Referring to FIG. 4B, also in the case of the ink jet recording head structure in this embodiment, small dots are formed with equal intervals at a resolution of 2,400 dpi, and large dots and medium dots are formed with equal intervals at a combined resolution of 2,400 dpi, as they were in the preceding embodiments. Therefore, it is possible to print an image at a higher level of quality.

On the other hand, if the head is tilted by the angle of θ relative to the primary scan direction as shown in FIG. 5, the ink droplets jetted from the head form dots in the pattern shown in FIG. 6; that is, the pattern in which areas which are high in dot density and areas which are low in dot density alternate. In this case, the areas which are high in dot density are high in image density, whereas the areas which are low in dot density are low in image density. Therefore, the recording head is more likely to form images which are nonuniform in density, and images which appear streaky.

However, if the head in this embodiment is operated while remaining tilted by the angle of θ relative to the primary scan direction, the areas of the resultant image, in which the portions which are high in cyan dot density and the portions which are low in cyan dot density alternate, is offset by ½ the pitch relative to the areas of the resultant image, in which the portions which are high in magenta dot density and the portion which are low in magenta dot density alternate. Thus, the cyan areas and magenta areas compensate for each other in terms of AF, making the resultant image appear uniform in density.

As described above, in the case of the ink jet recording head in this embodiment, even if the head becomes tilted by the angle of θ as shown in FIG. 5, the head is unlikely to form streaky images.

Incidentally, in the preceding preferred embodiments of the present invention, each group of ink jetting nozzle rows is made up of two rows of ink jetting nozzles, which are different in ink droplet size, and the ink jetting nozzles in one row are offset, in terms of the secondary scan direction, relative to the ink jetting nozzles in the other row so that, in terms of the secondary scan direction, the ink jetting nozzles of the two rows form a zig-zag pattern. However, the pattern in which the ink jetting nozzles are arranged does not need to be a zig-zag pattern. For example, the two cyan ink jetting rows CM1 and CL1*a*,which make up the cyan ink jetting row subgroup Cga, may be combined into a single row in which the medium cyan ink droplet jetting nozzles and large cyan ink droplet jetting nozzles are alternately positioned with equal intervals.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 190281/2006 filed Jul. 11, 2006, which is hereby incorporated by reference.

What is claimed is:

1. An ink jet head movable in a main scan direction, comprising:

a first group of ejection outlet arrays disposed at one side of a common liquid chamber and including a first ejection outlet array and a second ejection outlet array disposed adjacent to said first ejection outlet array, wherein amounts of liquid ejection of ejection outlets of said first ejection outlet array and amounts of liquid ejection of ejection outlets of said second ejection outlet array are different from each other, and said ejection outlets of said first ejection outlet array and said ejection outlets of said second ejection outlet array are disposed in a staggered arrangement;

a second group of ejection outlet arrays disposed at the other side of the common liquid chamber and including a common ejection amount ejection outlet array having ejection outlets for ejecting an amount of the liquid which is the same as one of the amounts of liquid ejection of said ejection outlets of said first ejection outlet array and said second ejection outlet array and including a non-common ejection amount ejection outlet array disposed adjacent to said common ejection amount ejection outlet array and having ejection outlets for ejecting an amount of the liquid which is different from the amounts of liquid ejection of said ejection outlets of said first ejection outlet array group, wherein said ejection outlets of said common ejection amount ejection outlet array and ejection outlets of said non-common ejection amount ejection outlet array are disposed in a staggered arrangement;

a plurality of sets each comprising said first ejection outlet array group and said second ejection outlet array group, wherein said sets are provided for each of at least cyan and magenta colors, respectively;

wherein said ejection outlets of said second ejection outlet array group are disposed with deviation of ½ of an interval at which said ejection outlets of said first ejection outlet array group are arranged, relative to said ejection outlets of said first ejection outlet array group, wherein in said non-common ejection amount ejection outlet arrays in different ones of sets for the same color, are disposed with deviation of ½ of an interval at which said ejection outlets of said non-common ejection amount ejection outlet arrays in said different ones of sets are arranged.

2. An ink jet head according to claim 1, wherein said common ejection amount ejection outlets are effective to eject a maximum amount of the liquid.

3. An ink jet head according to claim 1, wherein said common ejection amount ejection outlets are effective to eject a minimum amount of the liquid.

4. An ink jet head according to claim 1, wherein said common ejection amount ejection outlets are effective to eject a non-maximum and non-minimum amount of the liquid.

5. An ink jet head according to claim 1, wherein positions, with respect to a sub-scan direction which is crossing with the main-scan direction, of said ejection outlets in one of said sets are in mirror symmetry with positions, with respect to the sub-scan direction, of said ejection outlets in another one of said sets, wherein said one of said sets and said another one of said sets are for colors different from each other.

6. An ink jet head according to claim 1, further comprising at least one array of ejection outlets for yellow color, wherein said set for cyan color, said set for magenta color, said at least one array, said set for magenta color and said set for cyan color are arranged in the order named in the main scan direction.

7. An ink jet head according to claim 1, further comprising an array of ejection outlet for black color at and adjacent an outside of a combination of said sets for cyan, magenta, yellow, magenta and cyan colors.

8. An ink jet head according to claim 1, wherein in each of said ejection outlet array groups, said ejection outlets are disposed in a staggered arrangement.

9. An ink jet head movable in a main scan direction, comprising:

a common liquid chamber;

a first ejection outlet array disposed at one side of a common liquid chamber;

a second ejection outlet array disposed adjacent to said first ejection outlet array, wherein amounts of liquid ejection of ejection outlets of said first ejection outlet array and amounts of liquid ejection of ejection outlets of said second ejection outlet array are different from each other; and a first ejection outlet group including said first ejection outlet array and said second ejection outlet array, wherein said ejection outlets of said common ejection amount ejection outlet array and ejection outlets of said non-common ejection amount ejection outlet array are disposed in a staggered arrangement;

a third ejection outlet array disposed at the other side of the common liquid chamber and including ejection outlets for ejecting an amount of the liquid which is the same as one of the amounts of liquid ejection of said ejection outlets of said first ejection outlet array;

a fourth ejection outlet array disposed adjacent to said third ejection outlet array and having ejection outlets for ejecting an amount of the liquid which is different from the amounts of liquid ejection of said ejection outlets of said first ejection outlet array group;

a second ejection outlet group including said third ejection outlet array and said fourth ejection outlet array, wherein said ejection outlets of said third ejection outlet array and ejection outlets of said fourth ejection outlet array are disposed in a staggered arrangement;

a plurality of sets each comprising said first ejection outlet array group and said second ejection outlet array group;

wherein said ejection outlets of said second ejection outlet array group are disposed with deviation of ½ of an interval at which said ejection outlets of said first ejection outlet array group are arranged, relative to said ejection outlets of said first ejection outlet array group, and wherein in said fourth ejection outlet arrays in different ones of sets for the same color, are disposed with deviation of ½ of an interval at which said ejection outlets of said fourth ejection outlet arrays in said different ones of sets are arranged.

10. An ink jet head comprising:

a first ejection outlet array including a plurality of ejection outlets;

a second ejection outlet array including a plurality of ejection outlets for ejecting liquid with an ejection amount of liquid which is different from that of said first ejection outlet array;

a third ejection outlet array including a plurality of ejection outlets for ejecting liquid with an ejection amount of liquid which is the same as that of one of said first ejection outlet array and said second ejection outlet array;

a fourth ejection outlet array including a plurality of ejection outlets for ejecting liquid with an ejection amount of liquid which is different from that of said first ejection outlet array and different from said second ejection outlet array, wherein said first ejection outlet array and said second ejection outlet array constitutes a first ejection outlet array group, and said third ejection outlet array and said fourth ejection outlet array constitutes a second ejection outlet array group, and wherein said ejection outlets of said first ejection outlet array group are disposed with deviation of ½ of an interval at which said ejection outlets of said second ejection outlet array group are arranged, relative to said ejection outlets of said second ejection outlet array group, wherein in one of said sets, said first ejection outlet array, said second ejection outlet array, said third ejection outlet array and said fourth ejection outlet array are disposed in the order named in a predetermined direction, wherein in another one of said sets, said fourth ejection outlet array, said third ejection outlet array, said second ejection outlet array and said first ejection outlet array are disposed in the order named in a predetermined direction, wherein in said fourth ejection outlet arrays in different ones of sets for the same color, are disposed with deviation of ½ of an interval at which said ejection outlets of said fourth ejection outlet arrays in said different ones of sets are arranged.

* * * * *